US006386069B1

(12) United States Patent
Olivera et al.

(10) Patent No.: US 6,386,069 B1
(45) Date of Patent: May 14, 2002

(54) STOPPER EXTRACTOR

(76) Inventors: César Hugo Olivera; Roberto José Cardón, both of Perón 1219 3°"14", Ciudad de Buenos Aires (AR), 1038

( * ) Notice: Subject to any disclaimer, the term of this patent is extended or adjusted under 35 U.S.C. 154(b) by 0 days.

(21) Appl. No.: 09/822,744

(22) Filed: Mar. 30, 2001

(30) Foreign Application Priority Data

Oct. 25, 2000 (AR) ..... 000105625

(51) Int. Cl.[7] ..... B67B 7/18
(52) U.S. Cl. ..... 81/3.29; 81/3.37
(58) Field of Search ..... 81/3.29, 3.48, 81/3.09, 3.35, 3.37

(56) References Cited

U.S. PATENT DOCUMENTS

| | | | | | |
|---|---|---|---|---|---|
| 3,800,345 A | * | 4/1974 | Feliz | 7/156 |
| 4,519,277 A | | 5/1985 | Raab | 81/3.55 |
| 4,520,696 A | | 6/1985 | Wolze | 81/3.55 |
| 4,598,613 A | | 7/1986 | Baum | 81/3.37 |
| 4,680,993 A | | 7/1987 | Feliz | 81/3.37 |
| 4,729,267 A | | 3/1988 | Giebeler | 81/3.37 |
| 4,875,394 A | | 10/1989 | Crudgington, Jr. | 81/3.08 |
| 4,947,711 A | | 8/1990 | Giebeler | 81/3.37 |
| 5,016,499 A | * | 5/1991 | Saveland | 81/3.37 |
| 5,868,044 A | * | 2/1999 | Sonderman | 81/3.29 |

* cited by examiner

*Primary Examiner*—Joseph J. Hail, III
*Assistant Examiner*—David B. Thomas
(74) *Attorney, Agent, or Firm*—Emrich & Dithmar

(57) ABSTRACT

The present invention pertains to a manually operated stopper extractor device arranged to engage a bottle of carbonated liquid to remove the stopper. The extractor device includes a frame arranged to be centered about the neck of the bottle and a side support housing which encloses an actuation lever coupled to an extraction yoke. The yoke is operable between a disengaged and engaged position with the stopper. When the lever is in a compressed actuated position, the yoke engages the stopper and moves the stopper upwardly to remove the stopper from the bottle.

15 Claims, 4 Drawing Sheets

FIG. 3
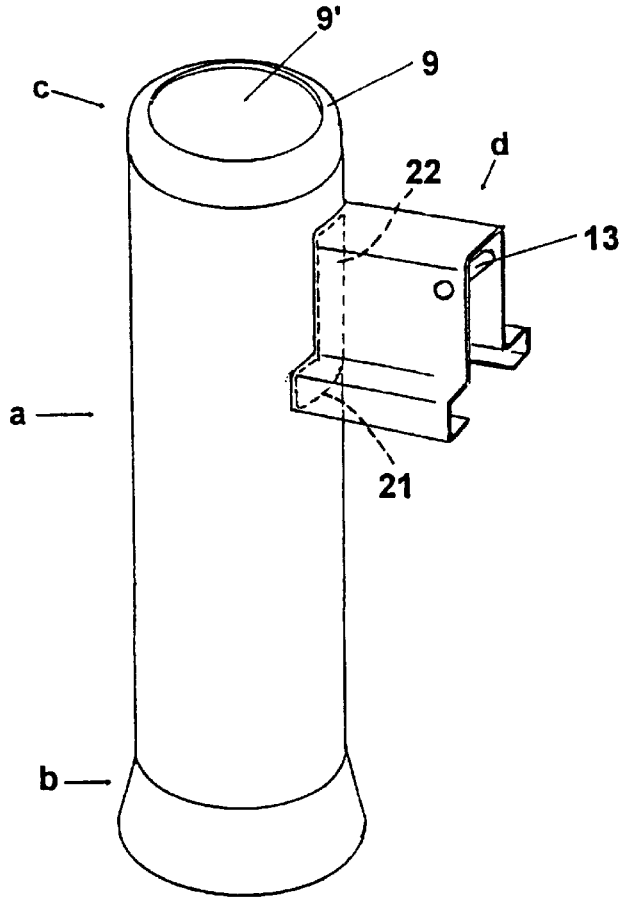
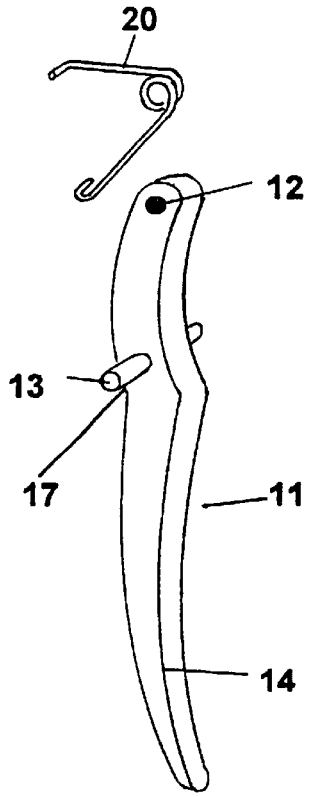
FIG. 3a
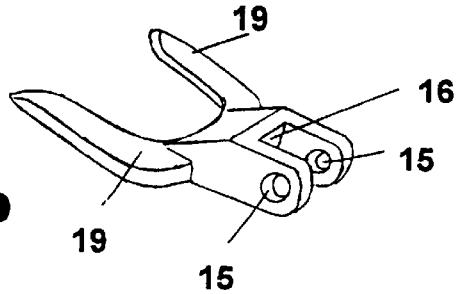
FIG. 3b

STOPPER EXTRACTOR

FIELD OF THE INVENTION

The present invention pertains to a manually-operated stopper extractor for a container filled with carbonated beverage, champagne, sparkling wine and the like, which is highly stable due to its self-centering support, having a very simple, effective mechanism utilizing an extracting yoke which prevents the stopper to be propelled under great force from the neck of the bottle.

BACKGROUND OF THE INVENTION

For centuries, stoppers have been made of natural cork due to the resilient features of this material, whose molecular resilient memory allows it to expand against the internal walls of the container neck which it closes.

At present, corks made of plastic materials are used as well, having functional, constructive designs similar to those made of cork. In both types of stoppers, either cork or plastic, the voluminous head formed on the stopper allows for the manual removal thereof.

Champagne bottles are opened by hand, with the user grasping the bottle around the neck and pushing against the cork with his or her thumbs. This operation requires a manual force and a degree of skillfulness. After the stopper is first moved outward from the neck of the bottle, the internal pressure of the gases within the container finally causes the stopper to be violently and speedily removed or expelled from the bottle. Such an occurrence may cause the user to suffer eye injuries and other types of injuries. This extraction task is typical and known and is virtually never left to a female or a child to accomplish.

Conventional, known stoppers are provided with a head by which they are manually removed or they can be removed using manual extractors of different types. Most manual extractors incorporate some type of a lever mechanism where the power arm is a manual handle. Strength is defined by means of a jaw provided for contacting the stopper and transmitting traction and rotation motion thereto. These manual mechanisms are used for removing stoppers in an attempt to make the task easier and quicker.

One of the drawbacks encountered with the prior art extracting devices is that their manufacture is quite complex. The other drawback is that they are difficult to handle by the user, especially for restaurant waiters, as both hands must be used, there is no means of retaining the stopper in the bottle neck and, also, because some of the beverage may be spilled during removal.

Several stopper extraction devices for sparkling beverages are known. U.S. Pat. No. 4,520,696 discloses an extraction tool having a unitary handle, a pair of side arms and a central jaw member which dislodge the stopper from the bottle neck. U.S. Pat. No. 4,519,277 relates to an extraction tool having a handle with one end having an opening wedge portion which is engageable with the head end of the stopper to wedge the stopper from the bottle. However, neither of these patents provide a method or device to prevent the stopper from being propelled under great force from the bottle. In such an instance, the stopper may strike an object or the user may be injured during removal of the stopper from the bottle neck.

U.S. Pat. No. 4,875,394 relates to a complex, difficult to use pliers-like device. Because the arms of the pliers remain away from the neck of the bottle, two hands are required to use the device. Accordingly, the risk of the bottle tipping and being unstable is a significant problem with such a device.

In U.S. Pat. No. 4,729,267 a stopper extracting/stopper insertion device is disclosed. The extractor is a mechanism comprising a gear assembly with several linkages. This mechanism is subject to failures and frequently gets choked when being operated, thereby requiring the user to exert an additional force to remove the stopper, such task being inconvenient for the user.

U.S. Pat. No. 4,598,613 discloses an extractor mechanism. This structure requires a side lever to move the mechanism. Because the fulcrum lies over a vertical elongated member, the force is exerted on the side of the bottle in an unbalanced condition which may cause the bottle to slip from the user's hands. U.S. Pat. No. 4,680,993 also relates to an extractor mechanism having a lateral handle. Thus the force is exerted laterally and presents the risk of the bottle slipping from the user's hands.

Finally, U.S. Pat. No. 4,947,711 discloses an extractor which is also based on an arm having a gear assembly. Such a complex structure is likely to become choked while being operated.

SUMMARY OF THE INVENTION

The present invention constitutes an improvement over the previous prior art devices because it can be operated with only one hand, and it is not necessary for the user to grasp the bottle.

The reason for this result is that the structure of the present invention is firmly mounted over the neck of the bottle with the handle projecting only a small portion from the frame of the extractor. Also, the present invention mechanism is based on a yoke which first engages the bottom of the head end of the stopper and then the yoke moves upwardly to dislodge the stopper from the neck of the bottle.

Additionally, the extraction of the stopper in accordance with the present invention takes place within a housing. Accordingly, the violent propulsion of the stopper from the bottle is prevented. This structure of the present invention provides the benefit of being safer for the user thereof.

DESCRIPTION OF THE DRAWINGS

The invention may be more easily understood from the following description of the drawings wherein a preferred embodiment is represented. The embodiment described is illustrative of the principles of the invention and is not to be restricted by the invention.

FIGS. 3, 3*a* and 3*b* are exploded perspective views of a manual extractor, according to the detail below;

FIG. 3 is a perspective view of the extractor frame;

FIG. 3*a* is a perspective view of the lever and the biasing spring;

FIG. 3*b* is a perspective view of the extracting yoke for stoppers;

In the different views, the same reference numbers have been used to show identical or similar parts, and letters have been used for denoting assemblies of the several elements.

DESCRIPTION OF THE EMBODIMENT

Figure 1:
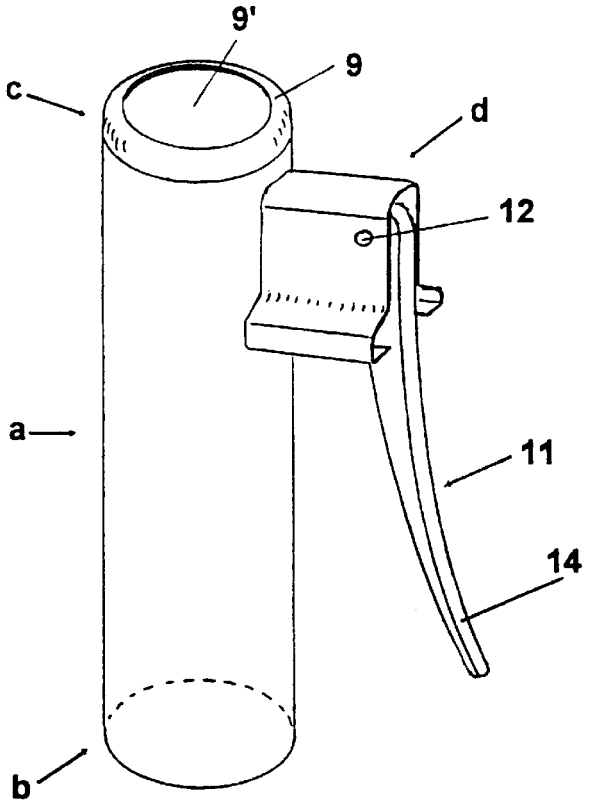
FIG. 1 is a perspective view of the exterior appearance of the manual extractor assembly in an embodiment wherein the housing detention end is opened and the self-centering end is tubular.
Figure 2:
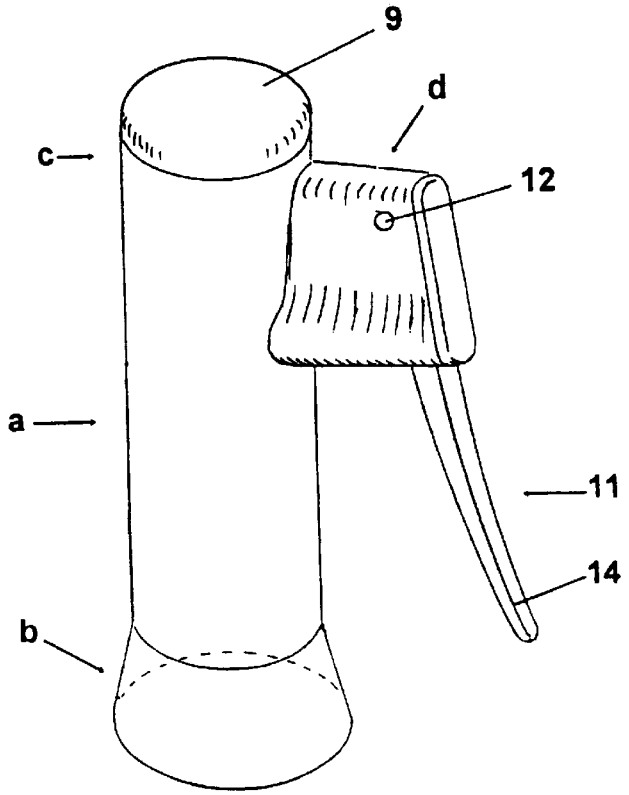
FIG. 2 is another perspective view similar to FIG. 1, but showing an embodiment wherein the housing detention end is closed and the self-centering end is funnel-shaped.

The present invention pertains to a manually operated stopper extractor for use with a container or bottle filled with a carbonated beverage, champagne, sparkling wine and the like. The stopper extractor device includes a frame portion (a) comprising a self-centering support (b) arranged to engage the neck 1 of the bottle (e) to attain the controlled extraction of the stopper 5 from the bottle (e). The actuation lever 11 is coupled by a linkage or posts 13 to an extraction yoke 19. The extraction yoke 19 has an operative path rectilinear in motion relative to the bottom 6 of the head 5 of the stopper (f). This linear motion wedges the stopper between the throat 2 to engagement with the head 5, as will hereinafter be described. The movement of the extraction yoke 19 is limited by a wall 18 engaging the intermediate portion 17 of the lever 11.

Figure 4:
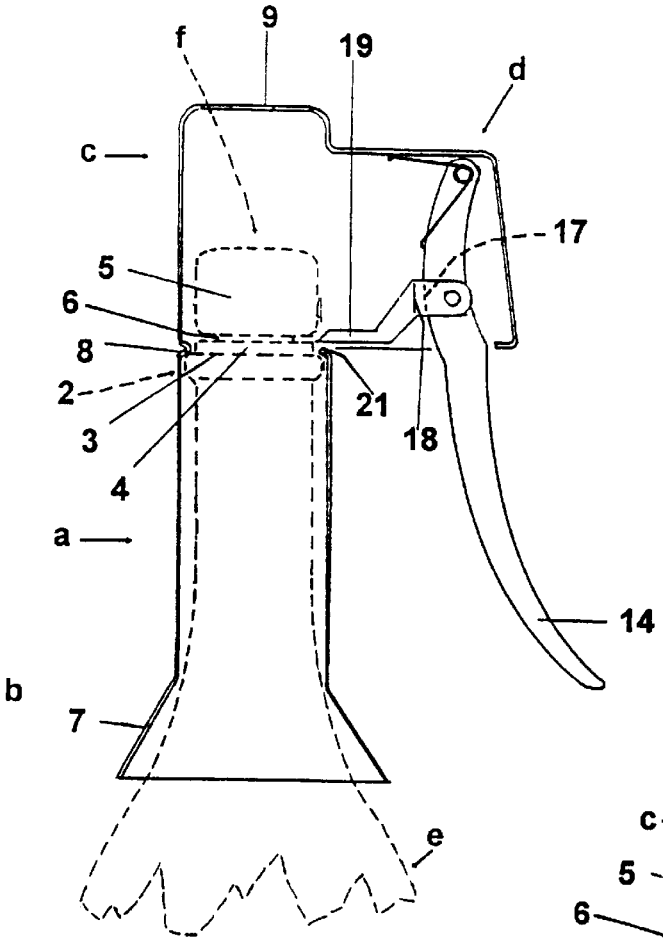
FIG. 4 is a longitudinal section of the extractor wherein the arrangement of the extracting mechanism for stopper removal may be seen.
Figure 5:
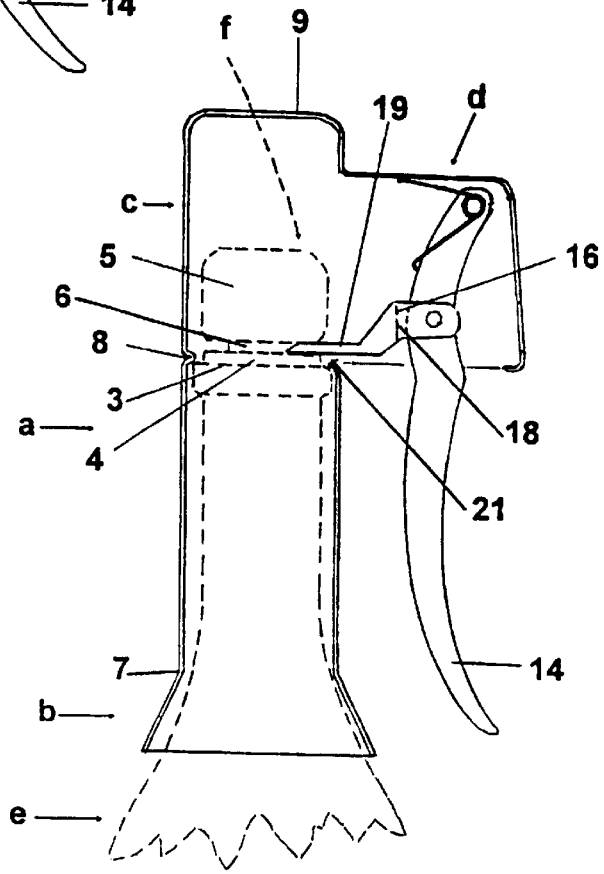
FIG. 5 is another longitudinal section, similar to that in FIG. 4, but where the rectilinear portion of the yoke path is shown to the point wherein the yoke engages the bottom of the head end of the stopper.
Figure 6:
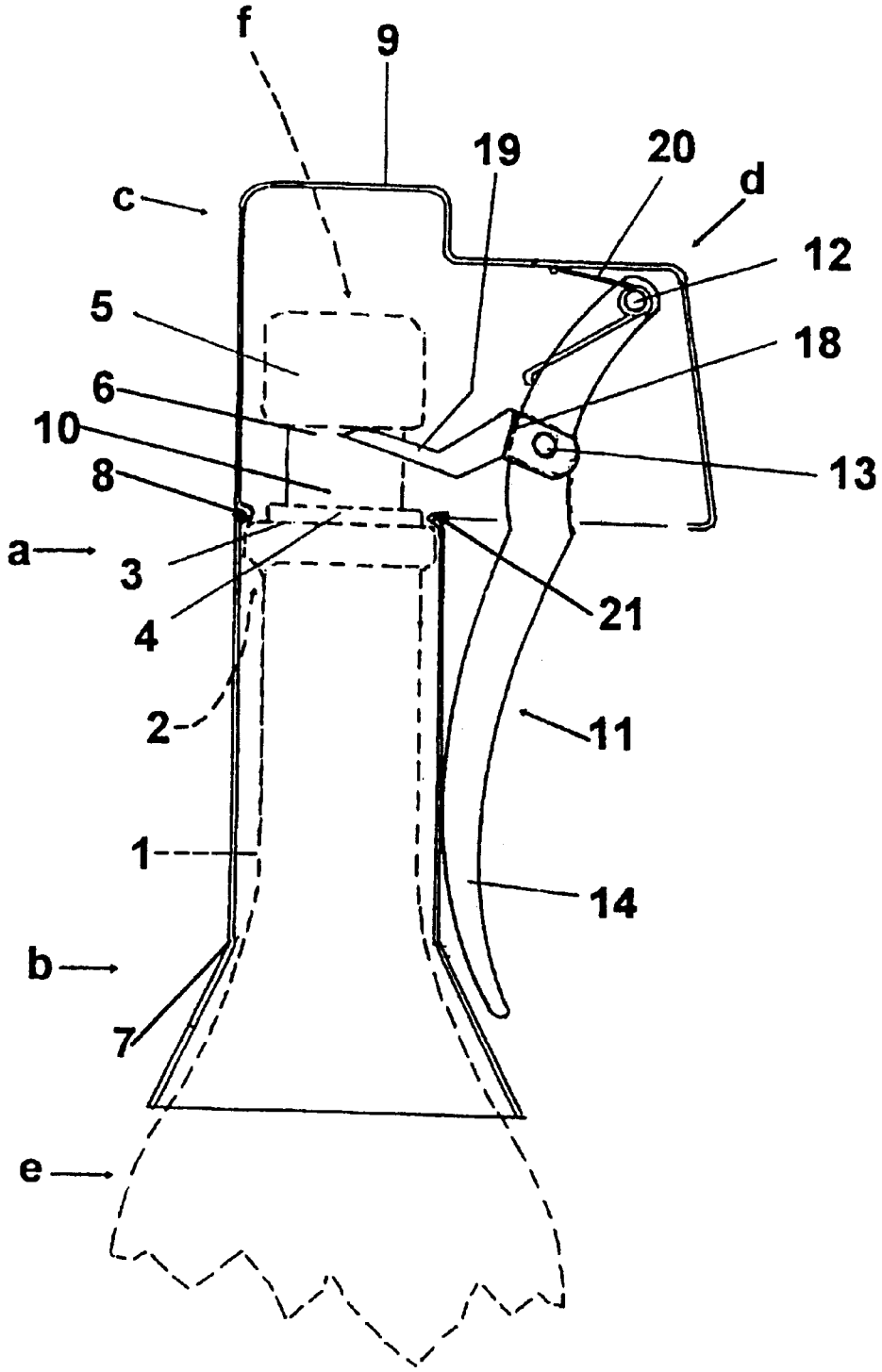
FIG. 6 is another longitudinal section, similar to that of FIG. 4, but wherein a portion of the yoke path diverges relative to the throat, whereby the extraction of the stopper from the bottle is accomplished.

More particularly, the stopper extractor may be applied to a bottle (e), filled with carbonated beverage, champagne, sparkling wine and the like, with the bottle having a neck 1 (FIG. 6) and a throat 2. The throat 2 has an end ring rib 3 formed in adjacent portions of a spout 4 that serves as a wedge of the interior body 10 of the stopper (f), as shown in FIGS. 4–6. The interior body 10 of the stopper (f) protrudes from the bottom 6 of the exterior end head 5 of the stopper.

The stopper extractor device comprises a frame (a) formed by positioning the selfcentering support portion (b) over the bottle neck 1. The self-centering support portion (b) has a self-centering end 7 surrounding the bottle (e), with the bottle neck 1 being the guide for the end 7, as shown in FIGS. 4–6. In different embodiments of the present invention, the self-centering end 7 may be either tubular or funnel-shaped.

In the intermediate portion of the frame (a), there is a supporting means comprising an interior projection 8 which, in different embodiments, may be formed by an interior protrusion or shoulder which serves as a support in the rib 3 of the throat 2, as shown in FIGS. 4–6. Above the self-centering support (b), there is a controlled-extraction housing (c) for retaining the stopper (f) upon removal from the bottle in the detention housing or end 9. This detention end 9, according to the present invention, may be closed or may present an opening 9; as shown in FIG. 3.

On a side of the extracting housing (c), there is a side support housing (d) containing the extraction mechanism portion of the stopper extractor. The extraction mechanism portion is comprised of an actuation lever 11 and an extraction yoke 19 which is engageable with the stopper (f). The actuation lever 11 is pivotally mounted by a fulcrum 12 to the side support housing (d). Thus, the strength formed by the extracting yoke 19 lies between the fulcrum 12 and the power lever 11 thereof. The power lever provides a handle 14 for operation of the extraction mechanism portion.

The yoke 19 is mounted to the lever 11 through a linkage or posts 13 mounted to the lever intermediate the ends thereof The flanges 15 of the yoke 19 join the intermediate portion 17 of the lever 11 through linkage posts 13. Between the flanges 15, the yoke 19 forms a recess bottom plate 16 disposed and positioned opposite of the intermediate portion 17, of the lever 11. The flanges 15 are spaced apart and provide a slack or gap I 8 when the lever 11 is in the outward vertical at-rest position, as shown in FIG. 4.

As shown in FIG. 3, the side support housing (d) communicates with the housing (c) by means of a side opening 22, the lower end of which acts as a sliding guide or wedge guide 21 for the yoke 19 to engage the bottom 6 of the head end 5 of the stopper (f). When the path of the lever 11 is arcuate from the at-rest position, as shown in FIG. 4, linkage 13 is coupled to the yoke 19, the slack or gap 18 and said wedge guide 21 define and provide a rectilinear operating path of the yoke 19 within the housing (c) to engage bottom of the head end 5, as shown in FIG. 5. Movement of the lever to the inner compressed actuated position lifts the stopper head 5 away from the throat spout 4.

The lever 11 has a resilient member 20, formed by a spring, which keeps the lever normally of the outward at-rest position. In this at-rest position, the yoke 19 lies laterally opposite the base 6 of the head end 5 of the stopper (f) because the path of travel thereof is transverse to the longitudinal axis of the extractor when the lever is moved to the intermediate position.

To operate the stopper extractor, the extraction frame (a) is mounted over the neck 1 of the bottle (e), the interior protrusion of the intermediate portion 8 and the self-centering end 7 of the self-centering support portion (b) orientate the wedge guide 21 around the throat 2 of the bottle.

When the operation handle 14 of the actuation lever 11 is operated between the at-rest and the actuated position, the lever undertakes an arcuate path. Because of the linkage 13, the slack or gap 18 and the wedge guide 21, the yoke 19 moves in a rectilinear direction along the bottom 6 of the head end 5 of the stopper (f), the position as shown in FIG. 5. At this point, the intermediate portion 17 of the lever 11 hits the bottom facing 16 of the gap 18 and the lever 11 and the yoke 19 move in cooperation therefrom in an upwardly direction to engage the head 5 of the stopper (f), the position as shown in FIG. 6. Thus, the yoke 19 undertakes an arcuate operative path which diverges upwardly from the throat position 2 to dislodge the stopper (f) from the bottle neck.

The violent propulsion of the stopper (f) by the compressed gas of the beverage inside the bottle (d) is limited by the detention end 9 of the housing (c). In an embodiment of the invention where the length of the controlled extraction housing (c) is much longer than the stopper (f), the stopper remains within the detention end 9 of the housing (c).

When the present invention is put into practice, several changes and modifications may be made to the constructive details and embodiments described above without departing from the inventive concepts therein. Therefore, the present invention is not to be restricted except in the spirit of the appended claims.

We claim:

1. An extractor device arranged to remove a stopper having a head end portion larger than the opening in the bottle neck the extractor device including:

a mounting frame structurally arranged to be centered about the throat of a bottle;

a side support housing associated with said mounting frame;

an actuation lever coupled to a yoke member and arranged to be pivotally mounted in said side support housing and movable between an at-rest and an actuated position;

an extraction and stopper retention housing structurally arranged to be positioned on the end of the mounting frame; and wherein said yoke member having a wedge portion is coupled to said actuation lever by a linkage limited by a gap in the yoke member, such that the initial pivotal movement of the lever from an at-rest position causes the yoke member to follow a rectilinear operating path between the bottle neck and the stopper head end portion, and with the continued movement of said lever to an actuated position, cause said wedge portion of said yoke member to engage the stopper head end portion and upwardly move the same to remove the stopper from the bottle neck.

2. The extractor device in accordance with claim 1, wherein said yoke member is pivotally mounted to said lever intermediate the ends thereof to provide the initial rectilinear movement of said yoke member between the stopper head and the opening of the bottle and the upward movement of the yoke member when said lever reaches said actuated position.

3. The extractor device in accordance with claim 1, wherein said actuation lever is engageable with a resilient member mounted in said retention housing to bias said lever to said at-rest position.

4. The extractor device in accordance with claim 1, wherein said actuation lever is pivotally mounted to said side support housing at the upper end of said actuation lever.

5. The extractor device in accordance with claim 1, wherein said mounting frame includes a self-centering support member comprised of a tubular portion having a free end resting on the bottle neck and an intermediate portion having a supporting member arranged to engage the throat of the bottle.

6. The extractor device in accordance with claim 5, wherein said supporting member arranged to engage the throat is an inner protrusion.

7. The extractor device in accordance with claim 1, wherein said extraction stopper housing is of sufficient width to permit the rectilinear movement of said wedge portion of said yoke member into and between the bottle neck and the stopper head end portion.

8. The extractor device in accordance with claim 1, wherein the height of said extraction stopper housing is greater than the length of the stopper.

9. The extractor device in accordance with claim 8, wherein said extraction stopper housing is open ended.

10. The extractor device in accordance with claim 3, wherein said resilient member is a compression spring.

11. The extractor device in accordance with claim 1, wherein said linkage between said lever and said yoke comprises a pair of lateral extending axes positioned on said lever which cooperate to engage a pair of space apart flanges extending from said yoke, with the wall between said flanges being spaced from said lever to provide a gap therebetween that defines the width of said linkage.

12. The extractor device in accordance with claim 1, wherein said wedge portion of said yoke member includes a pair of projections having a recess therebetween which engages the stopper head portion to remove said stopper from the bottle neck.

13. The extractor device in accordance with claim 1, wherein the path of travel of said rectilinear motion of said yoke member is transverse to the longitudinal axis of said mounting frame, and the path of travel of said yoke member is substantially parallel to the longitudinal axis of said mounting frame extractor during removal of the stopper from the bottle neck.

14. The extractor device in accordance with claim 5, wherein said free end is tubular.

15. The extractor device in accordance with claim 5, wherein said free end is funnel shaped.

* * * * *